United States Patent [19]

Bates

[11] 4,360,136

[45] Nov. 23, 1982

[54] TOOL FOR SHEARING OFF RIVET MOUNTED SICKLE TEETH

[76] Inventor: Merle R. Bates, 83011 N. Florence, Creswell, Oreg. 97426

[21] Appl. No.: 177,067

[22] Filed: Aug. 11, 1980

[51] Int. Cl.[3] ..... B26F 3/00

[52] U.S. Cl. ..... 225/103; 29/426.4; 83/613; 83/697

[58] Field of Search ..... 83/613, 697; 225/103; 29/426.4

[56] References Cited

U.S. PATENT DOCUMENTS

| | | | |
|---|---|---|---|
| 447,849 | 3/1891 | Todd | 83/613 X |
| 1,078,191 | 11/1913 | Gilchrist | 83/613 |
| 1,096,684 | 5/1914 | Collins | 83/613 |
| 1,299,134 | 4/1919 | Crompton | 225/103 |
| 1,491,022 | 4/1924 | Arbon | 83/613 |
| 2,101,434 | 12/1937 | Johnston | 225/103 |
| 2,961,907 | 11/1960 | Hohlbein | 29/426.4 X |
| 3,364,556 | 1/1968 | Cocce et al. | 83/697 X |

*Primary Examiner*—James M. Meister
*Attorney, Agent, or Firm*—James D. Givnan, Jr.

[57] ABSTRACT

A tool for removing damaged sickle teeth from a supporting sickle bar. A support member supports the sickle bar on edge with the damaged teeth being disposed within an open area of the tool. An impact member is vertically slidably mounted and transfers hammer blows to the tooth upper edge to cause shearing off of the rivets mounting the tooth to the sickle bar. The impact member, in its lowermost position, serves as an anvil during the riveting of a replacement tooth onto the sickle bar.

4 Claims, 3 Drawing Figures

TOOL FOR SHEARING OFF RIVET MOUNTED SICKLE TEETH

BACKGROUND OF THE INVENTION

The present invention pertains generally to a rivet shearing tool particularly suitable for removing damaged sickle teeth or section from a supporting sickle bar.

Sickle bar assemblies of the type such as carried by farm tractors generally include a reciprocal bar on which sickle teeth or sections are mounted in a side-by-side manner. Such teeth or sections coact with stationary pointed guards on the sickle bar assembly to sever the vegetation. Sickle teeth are occasionally damaged by contact with rocks or other debris which damage requires their replacement. Since on-the-site repair of a sickle knife was heretofore not possible, it has been the practice of many operators to carry a spare bar with knives thereon to avoid excessive down time while the original damaged knife was being repaired. The acquisition of a spare bar with knives mounted thereon represents a cost investment and inconvenience to the sickle operator.

SUMMARY OF THE PRESENT INVENTION

The present invention is embodied within a portable tool for repairing sickle bars in the field to avoid excessive down time and the need for having a costly spare sickle bar.

The present tool is of a size and weight as to permit convenient transport to the field work site. A tool base is adapted for placement on a flat surface such as the bed of a pickup truck or the ground. An upright member of the base supports an elongate sickle bar on edge. An impact member is mounted for vertical, sliding movement on the base and engages the uppermost surface of a damaged tooth on said sickle bar. Blows imparted to the impact member and tooth result in the shearing of rivets securing the damaged tooth to the sickle bar. Accordingly, time consuming punching out of rivets, as heretofore done at a remote workshop, is avoided. Thus the present tool enables timely on-the-spot repairs to minimize lost time and to preclude the need for a spare bar at considerable cost savings.

Tools utilizing downwardly exerted impact and biasing forces for the shearing of sheet metal are shown in U.S. Pat. Nos. 3,227,026 and 3,771,401 while a tool for shearing metal bars is disclosed in U.S. Pat. No. 3,590,674. A tool utilizing an impact member in combination with a cutting member is disclosed in U.S. Pat. No. 3,978,842. None of the known prior art tools is feasible for accomplishing the present objectives nor are they structurally similar to the present tool.

Important objects of the present invention include the provision of a highly portable tool for use in the field for shearing off rivets attaching damaged sickle cutting elements or teeth to their supporting bar; the provision or a tool having an impact member which, in addition to shearing off sickle cutting elements, may subsequently serve as an anvil during the riveting of new teeth onto the bar; the provision of a tool for shearing off sickle teeth from their bar while isolating the bar from damaging impacts; the provision of a tool wherein an impact member is slidably supported for vertical movement during reception of impact blows; the provision of a sickle assembly repair tool suitable for use at the site of sickle operation.

DETAILED DESCRIPTION OF THE PREFERRED EMBODIMENT

Figure 1:
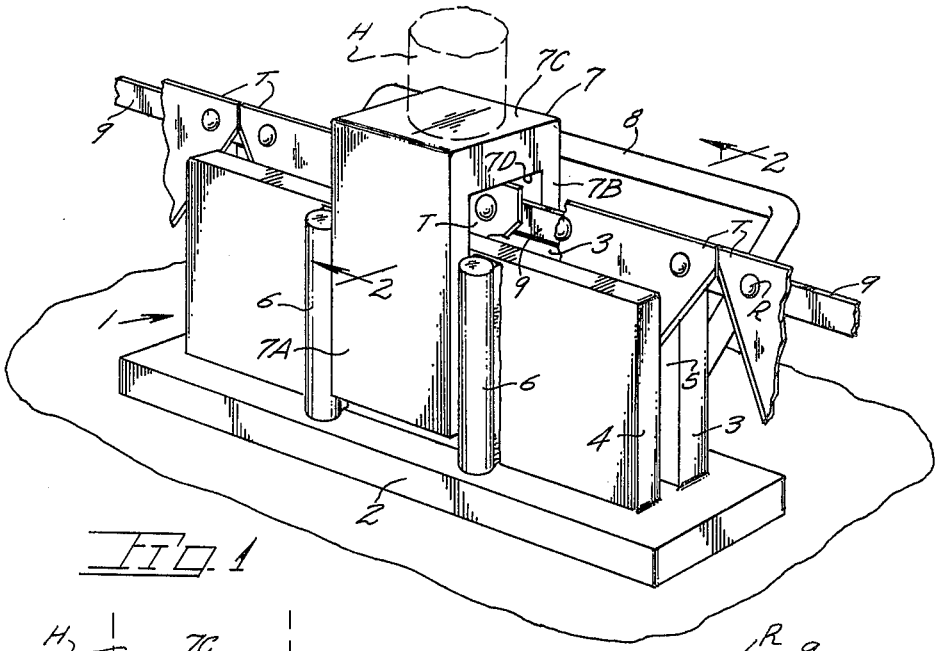
FIG. 1 is a perspective view of the present tool with a sickle bar in place thereon preparatory to removal of a cutting element therefrom.

With continuing reference to the drawing wherein applied reference numerals indicate like parts hereinafter identified, the reference numeral 1 indicates generally a tool base having an elongate platform 2 suitable for placement on the bed of a pickup truck or on a ground surface. The base includes an upright bar support member 3 which is laterally spaced a quarter of an inch or so from a companion upright member 4 to define a lengthwise orientated opening 5 therebetween. A pair of guides at 6 constitute guide means and are in place on platform 2 and member 4.

An impact member at 7 is of clevis shape and mountable on the base astride members 3 and 4 with downward legs 7A and 7B with the former intermediate guides 6 to guide impact member along a path perpendicular to platform 2. Said impact member has an upper, impact receiving surface 7C and a lower force imparting surface 7D.

Figure 2:
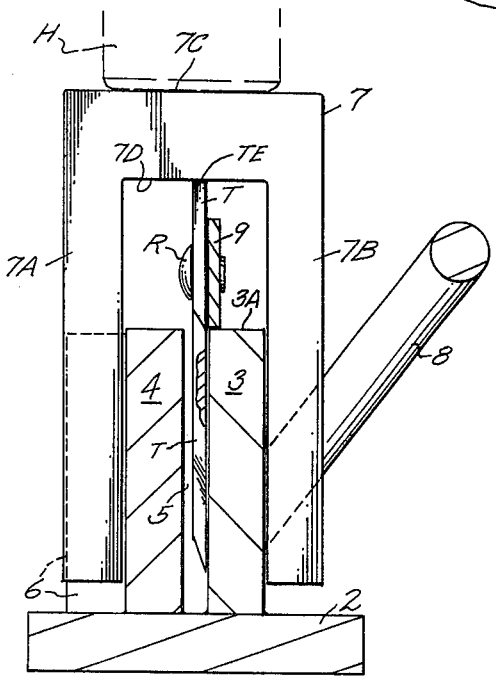
FIG. 2 is a vertical sectional view taken along line 2—2 of FIG. 1.
Figure 3:
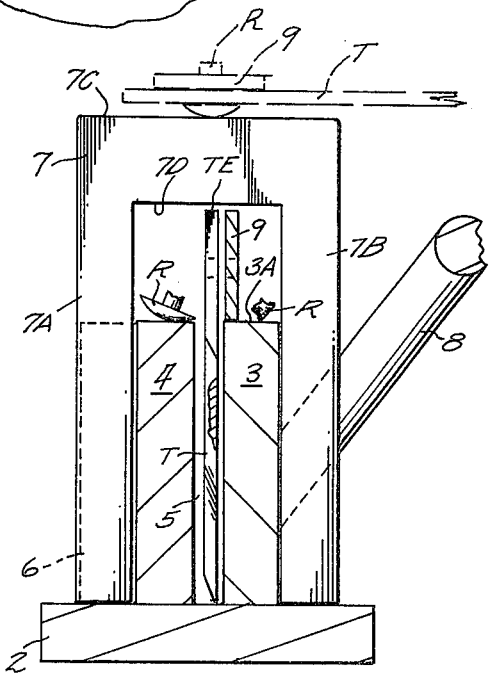
FIG. 3 is a view similar to FIG. 2 with the impact member shown at its lowermost limit of travel and used as an anvil.

Bar support member 3 includes a bar supporting upper surface 3A on which a sickle bar 9 is edgewise superimposed during tool use. With sickle bar 9 in downward edge abutment with bar supporting surface 3A the sickle tooth T is located within open area 5. With impact member 7 in rested contact on the tooth upper edge at TE, blows delivered to the impact member surface 7C (per FIG. 2) causes a shearing action to be exerted by the tooth and bar on the pair of button head rivets at R typically used for tooth securement. Accordingly, shearing of the rivet shanks takes place substantially along a plane coplanar with the abutting surfaces of the tooth and the bar. Importantly, impact member 7 bottoms out against platform 2, as shown in FIG. 3, before contact with sickle bar 9 to avoid risk of imparting damage to the bar. Impact blows from a hammer head H result in rivet shearing.

A handle at 8 facilitates carrying of the tool.

Impact member 7 may also serve as an anvil during tooth replacement when the bar 9 is placed on its side with the rivet heads being supported by surface 7C. The upwardly disposed end of the rivets (normally two per tooth) are then riveted in the usual manner per FIG. 3 as by hammering.

One suitable embodiment of the tool utilizes steel plate stock of one-half inch thickness for members 3 and 4 which are approximately eight inches in length and two and one-half inches in height. Impact member 7 is approximately four inches in overall height having its uppermost portion fabricated from three-quarter inch plate steel.

While I have shown but a few embodiments of the invention it will be apparent to those skilled in the art that the invention may be embodied still otherwise without departing from the spirit and scope of the invention.

Having thus described the invention, what is desired to be secured under a Letters Patent is.

I claim:

1. A tool for shearing rivets passing through and joining sickle teeth to a sickle bar, said tool comprising, a base including lengthwise extending upright support members having an opening therebetween, one of said support members having an upper planar surface on which a sickle bar may be temporarily positioned on edge with a sickle tooth disposed in said opening, guide means on said base, and an impact member mounted for vertical sliding movement on said guide means, said impact member being of clevis shape to straddle said support members and having an impact surface for contact with the edge of the sickle tooth whereby blows delivered to said impact member are imparted to and cause said tooth to impart a shearing force to rivets joining the sickle bar and tooth.

2. The tool claimed in claim 1 wherein said impact member has a planar surface at its upper end, said impact member at its lower limit of travel being in abutment with said base enabling an upper surface of the impact member to be utilized as an anvil in a riveting operation.

3. The tool claimed in claim 2 wherein said impact member includes legs of a vertical height greater than the combined vertical height of the first mentioned upright members and that of a sickle bar positionable thereon to at all times avoid damaging contact between the impact member and the sickle bar.

4. The tool claimed in claim 3 wherein said guide means comprises a pair of guides which cooperate with said upright support members to constrain the impact member for travel in a vertical path.

* * * * *